US006242994B1

(12) United States Patent
Li et al.

(10) Patent No.: US 6,242,994 B1
(45) Date of Patent: Jun. 5, 2001

(54) APPARATUS TO REDUCE PUSH BACK TIME IN SOLENOID VALVES

(75) Inventors: Zhixin Li, Hudson; Christian Ionescu, Nashua, both of NH (US)

(73) Assignee: Ferrofluidics Corporation, Nashua, NH (US)

( * ) Notice: Subject to any disclaimer, the term of this patent is extended or adjusted under 35 U.S.C. 154(b) by 0 days.

(21) Appl. No.: 09/268,958

(22) Filed: Mar. 16, 1999

(51) Int. Cl.[7] ..... H01F 3/00

(52) U.S. Cl. ..... 335/277; 335/257; 251/129.01; 251/129.15

(58) Field of Search ..... 251/129.01, 129.15, 251/12, 48, 64; 335/257, 277, 255, 271, 239, 240

(56) References Cited

U.S. PATENT DOCUMENTS

| | | | | |
|---|---|---|---|---|
| 2,575,360 | | 11/1951 | Rabinow . | |
| 2,667,237 | | 1/1954 | Rabinow . | |
| 3,108,777 | * | 10/1963 | Ray | 251/129.01 |
| 3,326,511 | * | 6/1967 | Hallgreen | 251/129.15 |
| 3,329,165 | * | 7/1967 | Lang | 251/129.01 X |
| 4,048,602 | | 9/1977 | Diamantides . | |
| 4,083,698 | | 4/1978 | Wenzel et al. . | |
| 4,090,112 | | 5/1978 | Selverstone . | |
| 4,306,207 | | 12/1981 | Tada et al. . | |
| 4,419,643 | | 12/1983 | Ojima et al. . | |
| 4,422,060 | | 12/1983 | Matsumoto et al. . | |
| 4,639,704 | | 1/1987 | Shand et al. . | |
| 4,831,291 | | 5/1989 | Ames . | |
| 5,246,199 | | 9/1993 | Numoto et al. . | |
| 5,268,662 | | 12/1993 | Uetsuhara et al. . | |
| 5,277,281 | | 1/1994 | Carlson et al. . | |

FOREIGN PATENT DOCUMENTS

| | | |
|---|---|---|
| 0052177 | 5/1982 | (EP) . |
| 57071108 | 5/1982 | (JP) . |

OTHER PUBLICATIONS

Patent Abstracts of Japan, vol. 6, No. 147 (E–123), Aug. 6, 1982 & JP 57 071108 A (Aisin Seiki Co. Ltd.), May 1, 1982.
Patent Abstracts of Japan, vol. 18, No. 3 (E–1485), Jan. 6, 1994 & JP 05 251228 A (Matsushita Electric Works Ltd.), Sep. 28, 1993.
Patent Abstracts of Japan, vol. 5, No. 145 (E–074), Sep. 12, 1981 & JP 56 079408 A (Matsushita Electric Works Ltd.), Jun. 30, 1981.
Patent Abstracts of Japan, vol. 6, No. 247 (E–146), Dec. 7, 1982 & JP 57 145565 A (Mitsubishi Denki KK), Sep. 8, 1982.
McGraw–Hill Dictionary of Scientific and Technical Terms, 4th ed, p. 706; definition of "ferrofluid".

* cited by examiner

*Primary Examiner*—Kevin Lee
(74) *Attorney, Agent, or Firm*—Kudirka & Jobse, LLP

(57) ABSTRACT

A solenoid with liquid in the gaps between a moving and stationary element is disclosed that includes a secondary kick-back spring used to overcome the viscosity and surface tension effects of the liquid in the gap during the de-energizing phase of the solenoid action. Various secondary spring designs as well as surface shapes of the butt or plunger ends are possible in order to decrease the contact surface area of the ends of either the moving or stationary elements used in the solenoid and also are also used to decrease the viscosity and surface tension effects of the liquid.

20 Claims, 6 Drawing Sheets

APPARATUS TO REDUCE PUSH BACK TIME IN SOLENOID VALVES

FIELD OF THE INVENTION

The present invention relates to a solenoid construction and in particular to a ferrofluid-based solenoid that includes a movable plunger surrounded by a ferrofluid. More particularly, the present invention relates to a movable plunger and a means to overcome the viscosity of the ferrofluid environment surrounding the plunger.

BACKGROUND OF THE INVENTION

A plunger solenoid is a device that includes an electrically energizable coil wound on a non-magnetic form within which a magnetic plunger may move. A solenoid includes a mechanical stop or butt to restrict plunger movement. The stop or butt is made of a magnetically permeable material. The non-magnetic form or spool, electrically energizable coil, plunger and mechanical stop are surrounded by a ferromagnetic casing such as steel that is formed of two parts. The casing includes a generally cylindrical element that surrounds the solenoid element and a pole piece. The plunger butt and pole piece are made of soft magnetic materials that can retain varying degrees of residual magnetism depending upon their composition. Since the solenoid contains no permanent magnetic field, the magnetic field is produced only when the coil is energized. When the coil is energized by passing an electrical current therethrough, a magnetic field is produced in and around the core volume within which the plunger is positioned. The casing, plunger, butt and pole piece together form a magnetic circuit which intensifies the magnetic flux in the air gaps between the plunger and the butt as well as between the plunger and the pole piece. Because of the magnetic field in the core volume, the movable plunger is pulled toward a central position within the coil. The more intense the magnetic field in the gaps between the plunger and the butt and between the plunger and the pole piece, the greater the force on the plunger.

Solenoids are widely used for operating circuit breakers, track switches, valves and many other electromechanical devices. Thus, the movable plunger may be attached to any one of variety of mechanical elements such as a seat of a valve, the movement of which can be utilized to control flow of gases or liquid through the valve. In use, as the moving plunger approaches the butt, the mechanical force of the moving plunger increases rapidly due to a decrease in the reluctance of the magnetic flux path. The plunger strikes the butt with maximum force thereby creating noise, vibrations and chattering in the solenoid. A significant problem associated with solenoids is that they tend to generate noise, caused by the plunger striking the butt and by the plunger rubbing against the walls of the core defined by the interior surface of the spool. The impact force against the butt and the frictional force against the core walls create wear particles which can cause wear on the plunger and on the spool which, in turn, limit the life of the solenoid. Typically, the plunger displacement is small such as less than 1 mm and the radial clearance between the plunger and the core wall is about 0.1 mm. In addition, the clearance between the pole piece and the plunger is also about 0.1 mm. Since there is no alignment mechanism for the plunger within the solenoid, the plunger may scrape the walls of the core, causing undesirable wear.

Noise generated by solenoid devices such as solenoid valves pose serious restrictions in their use in apparatus that must perform quietly. For example in medical applications such as dialysis machines, blood chemistry instruments, blood pressure monitors and ventilators/respirators, it is necessary that valves be quiet to assure patient comfort. Presently this is achieved by placing excessive acoustic foam insulation around the apparatus, which renders the apparatus large and bulky and therefore undesirable.

Ferrofluids are magnetically responsive materials and consist of three components: magnetic particles, a surfactant and a liquid carrier. The particles, typically $Fe_3O_4$, are of submicron size, generally about 100 Å in diameter. The magnetic particles are coated with a surfactant to prevent particle agglomeration under the attractive Van der Waals and magnetic forces and are dispersed in the liquid carrier. Ferrofluids are true colloids in which the particles are permanently suspended in the liquid carrier and are not separated under gravitational, magnetic and/or acceleration forces. The liquid carrier can be an aqueous composition, an oil composition or an organic solvent composition.

Ferrofluids are helpful in that they eliminate or substantially reduce the noise associated with solenoid action. In order to return the plunger to its original position before energizing the magnet used to drive the plunger, a primary spring is used to push the plunger back when the electromagnet is turned off. The travel of the plunger is typically much less than the compressible range of the primary spring. Thus, during the travel of the plunger, the force of the primary spring is relatively constant compared with the magnetic force, which varies greatly over small changes in the plunger position. The difference between the magnetic force and the primary spring force increases dramatically with the decrease of the gap between the plunger and the gap. When the gap approaches zero, the primary spring force is very weak compared to the magnetic force.

This relative weakness of the primary spring force at small gap distances causes undesirable effects to the performance of the solenoid valves. For example, during the operation of the valves, certain liquids can be present at the plunger/butt interface. The liquid can either come from the working agent the valve is controlling, or a lubricant, or a noise reduction agent, such as a magnetic ferrofluid previously discussed. Once the plunger and the butt become close together, the viscosity and surface tension effects of the liquid at the interface tend to keep the plunger from moving away from the butt. A weak spring force may greatly extend the time needed to push-back the plunger, resulting in a slow de-energizing response time that is undesirable in many applications.

Accordingly, it would be desirable to provide solenoids that can be operated with a quick de-energizing response time, a time faster than the spring force of the primary spring would otherwise allow.

SUMMARY OF THE INVENTION

The present invention provides a solenoid that includes a liquid, such as a ferrofluid, surrounding a portion of a plunger positioned within the solenoid, a primary spring, coupled to the plunger, a butt piece having a surface to stop the plunger movement within the solenoid, and a mechanism to overcome the surface tension and viscosity effects of the liquid when the plunger and the butt piece are touching during the solenoid action. The mechanism can include either a secondary spring that provides enough spring force to overcome the viscosity and surface tension effects or it can be an altered surface portion of either the plunger or the butt faces that touch during the solenoid action. These surfaces can include, but are not limited to, a single or multiple steps, selected grooves, a radius of curvature, or scored sections. In one embodiment, the kick-back or secondary spring is made of a thin sheet metal, such as stainless steel or a magnetic spring washer, with a total compressible range less than the travel of the plunger. It is placed in the gap between the plunger and the butt by attaching it to the plunger, or the butt, or standing alone.

The ferrofluid is positioned within a gap between the plunger and a non-magnetic spool which supports a coil, a gap between the plunger and the butt and a gap between the plunger and the pole piece. The ferrofluid reduces the noise produced by the actuated plunger since the ferrofluid positioned between the butt and the plunger acts as a cushion for the moving plunger. In addition, the ferrofluid minimizes the production of noise caused by undesirable vibration of various solenoid elements, particularly the plunger.

The ferrofluid positioned within the solenoid also provides additional operating advantages of the solenoid. The ferrofluid provides excellent lubrication of the moving parts of the solenoid since the ferrofluid includes a lubrication liquid. This, in turn, materially reduces wear of the solenoid since production of wear particles caused by frictional and impact forces is materially reduced. Since ferrofluids can be manufactured from a wide variety of liquids for suspending ferromagnetic particles, the damping coefficient of the ferrofluid can be varied over a wide range depending upon the liquid used in the ferrofluid. In addition, since the ferrofluid surrounds the plunger, magnetostatic forces on the plunger effect its alignment within the core of the solenoid, thereby providing an additional means for reducing wear.

While the ferrofluid minimizes noise levels by converting undesirable vibrational energy into heat through the viscous shear effect, the ferrofluid also functions as a larger heat sink as compared to the air in present solenoids. In this manner, the ferrofluid not only dissipates heat caused by vibration energy, but it also dissipates the heat from the energized winding. This, in turn, reduces coil temperature and coil resistance; thereby improving the power rating of the solenoid. Furthermore, since ferrofluids are a soft magnetic material, they exhibit no magnetic losses when present in the gap. Lastly, since the substrate liquid comprising ferrofluids is substantially chemically inert, its presence within the gaps of the solenoid prevent the elements of the solenoid adjacent to the gaps from corroding due to chemically active environments within which the solenoid may be placed.

BRIEF DESCRIPTION OF THE DRAWINGS

The above and further advantages of the invention may be better understood by referring to the following description in conjunction with the accompanying drawings in which.

DETAILED DESCRIPTION OF THE PREFERRED EMBODIMENT

Figure 1:
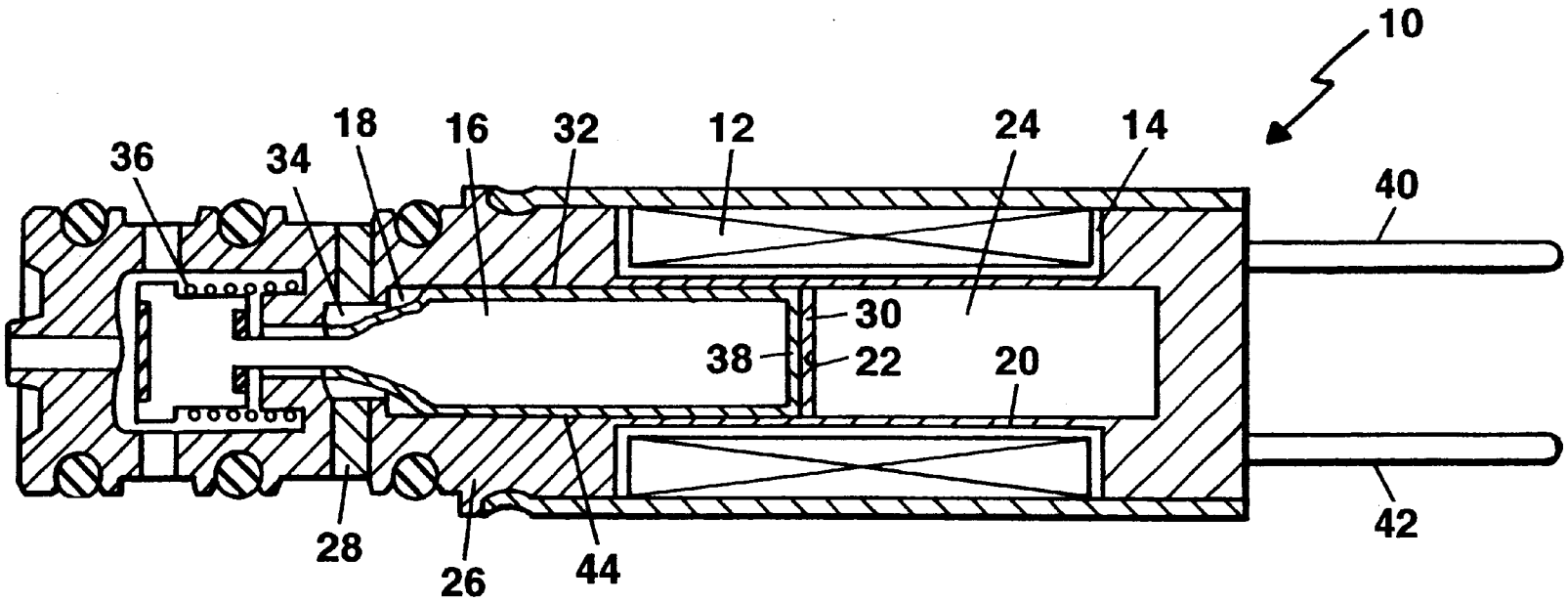
FIG. 1 is a cross sectional view of a solenoid of this invention.

The solenoid of this invention includes an insulated low resistance wire such as a copper wire wound on a nonmagnetic spool support made, for example, from a polymeric composition. A plunger formed of a magnetically permeable material is positioned within the core volume of the spool and is free to move within the core volume. A primary spring is mated to the plunger to return the plunger to its original position prior to the solenoid being energized to move the plunger. The primary spring force is weak relative to the magnetic force generated during the energizing of the solenoid. A mechanical stop or butt also is positioned within the core volume of the spool. The butt is also formed of a magnetically permeable material but is not free to move within the core volume within the spool. The butt is conveniently fixed in position by securing it to the inside surface of the spool that defines the core volume. A casing for the spool, wire coil, plunger and butt is formed of two pieces which are positioned to secure the other solenoid elements in place. One piece of the casing is a generally cylindrical element and the second piece of the casing is a generally circular flat element, referred to as the pole piece. This is secured to the generally cylindrical element. Small gaps containing liquid, such as a ferrofluid, are provided between the butt and the spool, between the plunger and the spool and between the plunger and the butt. A mechanism is provided between the plunger and the butt elements to overcome the viscosity and surface tension effects that are generated by the liquid used. This mechanism can include either a secondary spring, which may or may not have a spring force greater than the primary spring, a modified surface area of either the plunger or butt ends, or a combination of the two.

The secondary spring, also known as a kick-back spring, is made of a thin sheet metal with a total compressible range less than the travel of the plunger. It is placed in the gap between the plunger and the butt by attaching it to the plunger, the butt, or standing alone. The secondary spring can be made of a ferromagnetic material, such as 400 series stainless steel, so that the impact of the magnetic circuit is minimized. In alternative embodiments, the spring can be made with a magnetic material to be enhanced during the energizing action of the solenoid. Other embodiments can include elastic materials such as plastics, polymers, or rubber compounds.

At the beginning stage of energizing the solenoid, the kickback spring has no effect to the plunge action because it is not in contact with the plunger. When the plunger travels so far as to start compressing the kickback spring, the magnetic force increases to a much higher level than the additional spring force and is insignificant to the motion of the plunger. Thus, the kickback spring has very little effect on the energizing, or pole end, response time. When the gap approached zero, however, the kickback spring force is significant compared with the primary spring force, which helps to overcome the viscosity and surface tension effects and greatly improves the de-energizing, or push-back response time.

The de-energizing response time can also be reduced by certain other means, such as a step at the plunger/butt interface that reduces the direct contact area and increases the minimum gap at the rest of the interfacing area. This is because the effects of viscosity and surface tension are reduced with the gap as the contact area decreases. The types of geometries include a radius, grooves, scored marks, or the like can also be used for this purpose.

For use in the present invention, if a ferrofluid is being initialized, it is preferred that natural or synthetic oil based ferrofluids be utilized. The synthetic oils provide high thermal stability, wide operating temperature range, very low volatility and excellent lubrication properties. Representative suitable synthetic oils include hydrocarbons, esters, silicones, silahydrocarbons, polyphenyl ether, fluorocarbons, chlorofluorohydrocarbons or the like. Generally, in the absence of an external magnetic field, ferrofluids behave like ordinary liquids as if possessing no magnetic properties and therefore will leak out of the working gap of a device in the absence of a magnetic field. This is due to the fact of that the magnetic moments of individual particles in a zero field cancel out and the net magnetization of the fluid is zero. When a magnetic field is applied to the fluid, the magnetic vectors orient themselves along the field lines resulting in a net magnetic moment of the fluid. The force that retains a ferrofluid in a magnetic gap is a product of the magnetic moment of the fluid and the magnetic field strength in the gap.

Magnetic materials utilized to form the plunger, butt and pole piece of the solenoid can retain varying degrees of residual magnetism depending upon their composition. When the magnetization of the ferrofluid is sufficiently high, it can be retained within the solenoid by the residual induction of the soft magnetic materials in the static condition. Under dynamic conditions, when the accelerating forces are large, the additional magnetic field produced by the coil ensures further retention of the ferrofluid within the solenoid. Thus, the working solenoid provides a sufficient permanent magnetic field to prevent the ferrofluid from leaking from the solenoid through the gap between the plunger and the spool or pole piece. Embodiments of this invention are provided which include a permanent magnet positioned at various locations within the solenoid and are described in more detail below with reference to the figures. These permanent magnets provide an increased magnetic field and thereby further increase dampening, reduce wear, decrease noise level and provide centering force to the plunger within the core volume. The ferrofuids utilized in the present invention generally have a viscosity between about 50 and 25,000 cp at 27° C., have an evaporation rate less than 10-8 gm/cm2-C. at 100° C. and a relative magnetic permeability of about 1.1 to 5.5. Ferrofluids which have a viscosity of about 2,000 cp at 27° C. or higher are retained within the solenoid merely by viscous effects without the need for a residual magnetic field.

When utilizing a permanent magnet in the solenoid of the this invention, the permanent magnet is positioned so that the field produced by the magnet extends in the same direction. Typical permanent magnets are formed from ferrites, AlNiCo, Sn—Co and Nd—Fe—B.

Referring to FIG. 1, a solenoid is illustrated. The solenoid 10 includes an electrically energizable coil 12, such as a copper coil, which is wound about a spool 14 formed of a non-magnetic material. A plunger 16 formed of a magnetic material is positioned within core volume 18 defined primarily by the inside cylindrical wall 20 of spool 14. The plunger 16 is movable within core volume 18 between the top surface 22 of butt 24 and to a position which is regulated by the strength of the magnetic field produced by energized coil 12. The butt 24 is fixed to the casing 26 and/or the inside wall 20 of spool 14. The butt is formed from a magnetic material. The housing for the solenoid 10 is formed from a casing 26, formed from a magnetic material and a pole piece 28, also formed from a magnetic material. The plunger 16 extends through the pole piece 28. A gap 30 is provided between the butt 24 and the plunger 16 to permit movement of the plunger 16. A gap 32 between the plunger 16 and the casing 26 and a gap 34 between the plunger 16 and the pole piece 28 also permit the plunger 16 to move within the solenoid 10. The gaps 30, 32 and 34 contain a ferrofluid 44. The plunger further includes a primary spring 36 that is utilized to push the plunger back to its original position prior to the energizing action of the solenoid.

Figure 2:
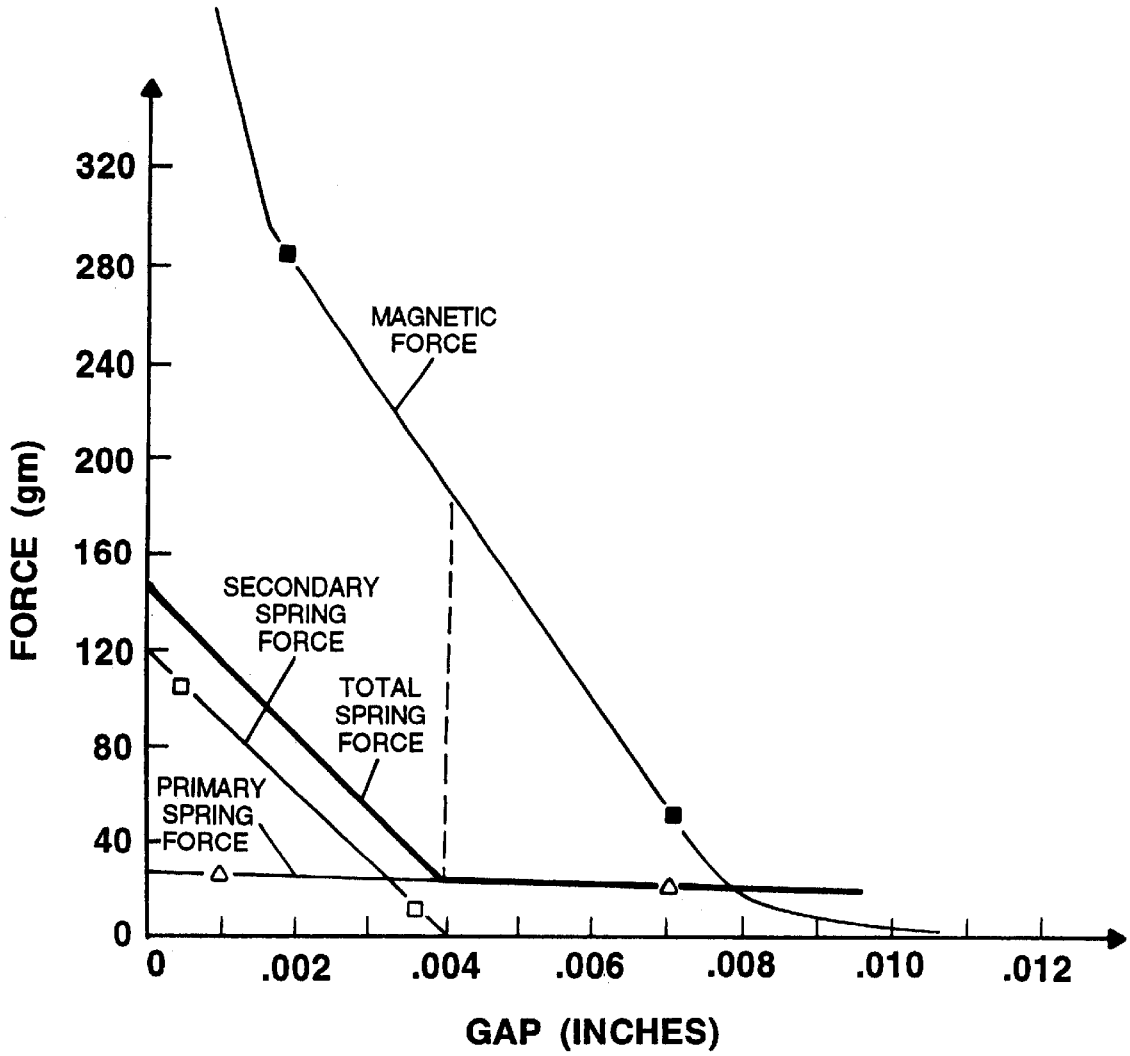
FIG. 2 is a graph depicting the force of the solenoid magnet and the spring forces of the primary and secondary springs in relation to distance according to the present invention.
Figure 4:
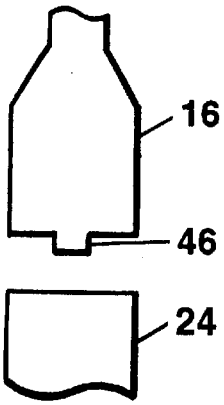
FIG. 4 is a cross sectional view of a step as applied to the surface tension reduction means of FIG. 1.
Figure 5:
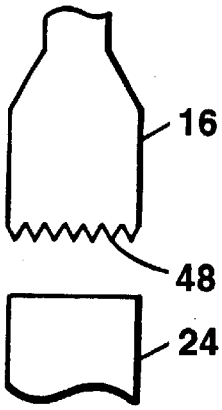
FIG. 5 depicts grooves used to reduce the surface tension according to FIG. 1.
Figure 6:
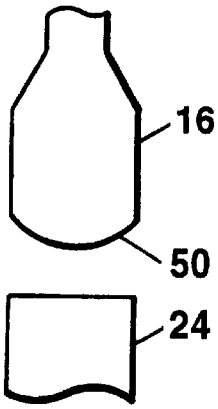
FIG. 6 depicts the use of a radius to reduce the surface area in accordance with the present invention.

The spring force of primary spring 36 is relatively weak compared to the magnetic force generated by the energizing of the solenoid 10. The primary spring force ranges from 25 to 35 grams as is shown in FIG. 2. A mechanism 38 is utilized between plunger 16 and butt 24 to reduce the de-energizing response time. Mechanism 38 can include a secondary spring as shown in FIGS. 3A–3E. Alternative embodiments for the mechanism 38 are also shown in FIGS. 4–6. The electrical energy applied to leads 40 and 42 of coil 12 can be either AC or DC electrical energy and generates a magnetic field within the solenoid.

When mechanism 38 includes a secondary spring, the secondary spring increases the total spring force exerted on the plunger during the energizing phase of solenoid 10. FIG. 2 is a graph depicting the gap distance between plunger 16 and butt element 24 versus the force applied to plunger 16 via the magnetic force as well as the countering force of the springs. Primary spring 36 has a force ranging from 25 to 35 grams. Secondary spring in the form of mechanism 38 has a spring force varying from zero to as high as 120 grams, depending upon the amount the spring has been compressed. The secondary spring 38 greatly increases the de-energizing spring force of the primary/secondary spring combination. Further, the secondary spring has no effect to the initial stage of energizing as the spring is not in contact with the butt 24 until the gap is closed by the magnetic force applied to plunger 16. In the present embodiment, the gap ranges from zero to 0.009 inches, with 0.007 inches being the preferred maximum gap. The primary/secondary spring force has a range of between 120 to 180 grams, with 150 grams being the preferred maximum force.

Figure 3A:
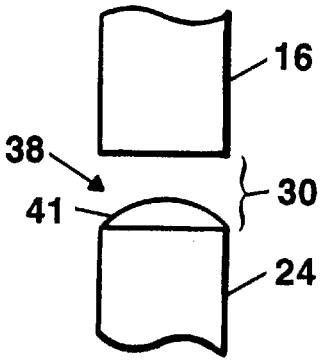
FIG. 3A is a cross sectional view of the secondary spring of FIG. 1.

FIG. 3A depicts a cross-sectional view of mechanism 38 as shown in FIG. 1. Mechanism 38 in FIG. 3A comprises a plunger 16, a butt 24, and a secondary spring 41, which is coupled to butt 24. The placement of spring 41 can be either on plunger 16 or butt 24, or the placement of spring 41 may be as a spring washer that fits between plunger 16 and butt 24 without actually being mechanically connected to either element. Spring 41 has a height smaller than the plunger gap 30. The spring force does not resist the plunger motion at pull down when the magnetic force is small. The spring force, however, does provide additional force to separate the plunger and butt when the de-energizing or push-back step is performed. The material used to make spring 41 can be magnetic to reduce the impact to the magnetic circuit.

Figure 3B:
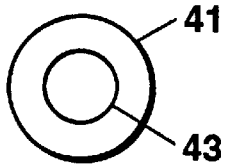
FIG. 3B–E illustrate top plan views of various embodiments of the secondary spring washer of FIG. 3A.
Figure 3C:
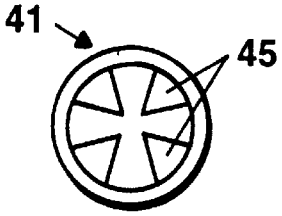
Figure 3D:
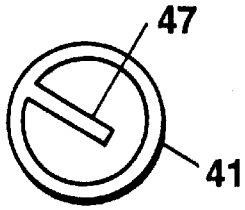
Figure 3E:
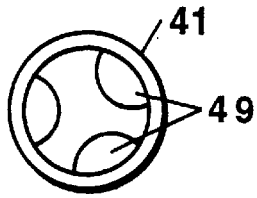

Spring 41 is a semispherical washer with an opening 43 on the top as illustrated in FIG. 3B. Alternative springs 41 are illustrated in FIGS. 3C–E. FIG. 3C depicts a top plan view of spring 41 having spring prongs 45 aligned on the inner circumference of spring 41. FIG. 3D illustrates another top plan view of spring 41 having a single spring extension 47 aligned on the inner circumference of the spring. FIG. 3E illustrates a top plan view of spring 41 having a plurality of semicircular spring extensions 49 aligned along the inner circumference of the spring. Other embodiments are possible and the examples of FIGS. 3A–E are merely illustrative and not intended to be exhaustive in the type of spring that can be utilized for spring 41.

FIGS. 4–6 are cross-sectional views of an alternative mechanism 38 that rely on varying the surface area of either the plunger or butt ends in order to reduce the de-energizing response time. FIG. 4 depicts the use of a step 46 at the end of plunger 16. FIG. 5 depicts the use of grooves designed into the end of plunger 16 (or the end of butt 24). Groove 48 can be either square, rounded, or saw-toothed in shape. FIG. 6 depicts the use of a radius 50 to reduce the actual surface area in contact between plunger 16 and butt element 24 to reduce the viscosity and surface tension effects of the liquid placed in the gap between the two elements. Of course, the use of either of the geometries shown in FIGS. 4–6 can be done in conjunction with the use of secondary spring 41 of FIGS. 3A–3E.

Figure 7:
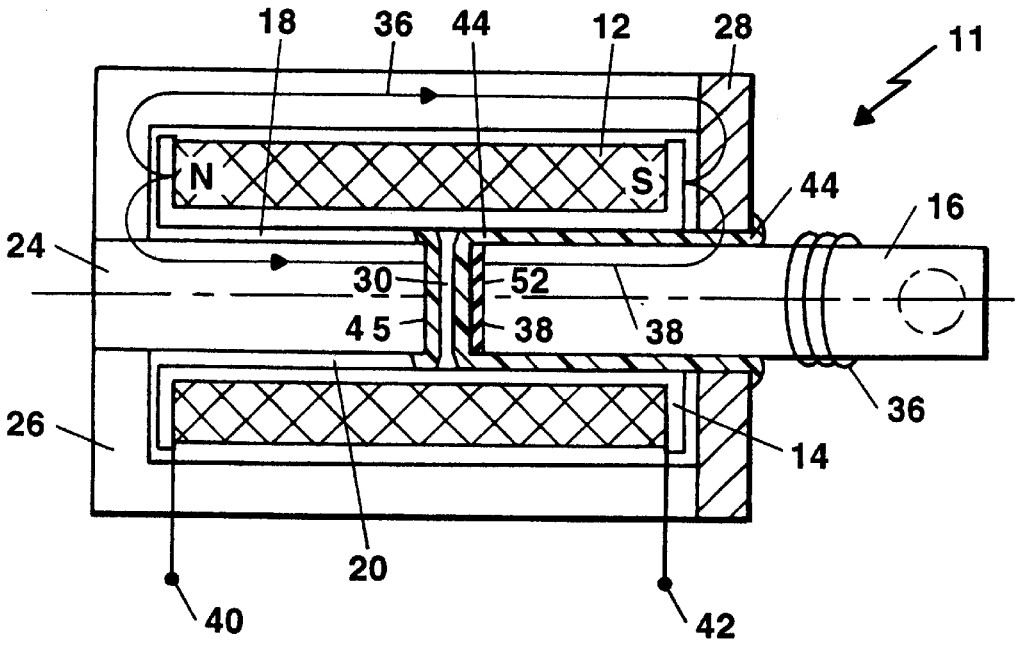
FIG. 7 is a cross sectional view of an alternative embodiment of the solenoid of this invention.

FIGS. 7–12 illustrate various embodiments of the invention. In FIGS. 7–12 like elements to the elements of FIG. 1 will be referred to by the same reference numbers. Referring to FIG. 7, the solenoid 10 includes an electrically energizable coil 12 which is energizable by applying a voltage between leads 40 and 42, a spool 14 formed from a non-magnetic material, a movable plunger 16 formed from a magnetic material, a non-movable butt 24 formed from magnetic material, a casing 26 formed from a magnetic material and a pole piece 28 formed from a magnetic material. A primary spring 36 is mounted to movable plunger 16 in order to return plunger 16 to its original, non-energized, position. The de-energizing mechanism 38 fits in the gap between plunger 16 and butt 24 to urge plunger 16 and butt 24 apart once de-energization has occurred and the solenoid returns to a non-energized state. A ferrofluid 44 is positioned (a) within the gap 30 between the plunger 16 and the butt 24, (b) within a gap between the butt 24 and the interior wall 20 of the spool 14 and (c) within the gap between the inner wall 20 of spool 14 and the plunger 16. Under influence of the magnetic field, the ferrofluid 44 coats the face surface 45 of the butt 24 and the face surface 51 of the plunger 16. The ferrofluid 44 positioned within gap 30 provides the functions set forth above, particularly reducing or eliminating noise by cushioning the impact between the movable plunger 16 and the stationary butt 24. The ferrofluid 44 positioned between the plunger 16 and the inner wall 20 of the spool 14 also provides the functions set forth above to center the plunger 16 within the core volume 18 and to minimize or prevent friction between the movable plunger 16 and the stationary wall 20.

Figure 8:
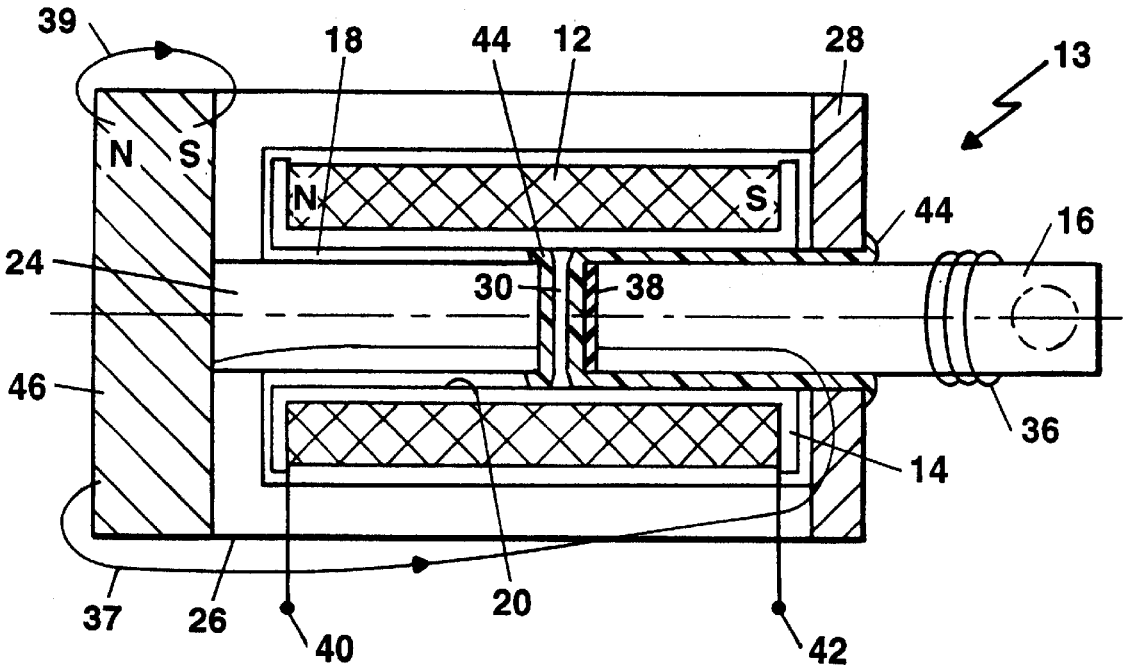
FIG. 8 is a cross sectional view of a solenoid of this invention including a permanent magnet.

Referring to FIG. 8, in another embodiment the solenoid 13 includes an electrically energizerable coil 12, a spool 14 which supports the coil 12, a movable plunger 16, an immovable butt 24, a casing 26, leads 40 and 42 and a pole piece 28. The solenoid 13 includes a permanent magnet 46 attached to the casing 26 outside of the core volume 18. A primary spring 36 is mounted to movable plunger 16 in order to return plunger 16 to its original, non-energized, position. The de-energizing mechanism 38 fits in the gap between plunger 16 and butt 24 to urge plunger 16 and butt 24 apart once de-energization has occurred and the solenoid returns to a non-energized state. A ferrofluid 44 is positioned (a) in the gap 30 in contact with both the butt 24 and the movable plunger 16, (b) within the space between inner wall surface 20 of spool 14 and the plunger 16 and (c) the gap between wall 20 and butt 24. The magnet 46 improves retention of the ferrofluid 44 within the solenoid 13. The ferrofluid 44 functions in the manner described above to provide the advantages described above, particularly with reference to the description of FIG. 1.

Figure 9:
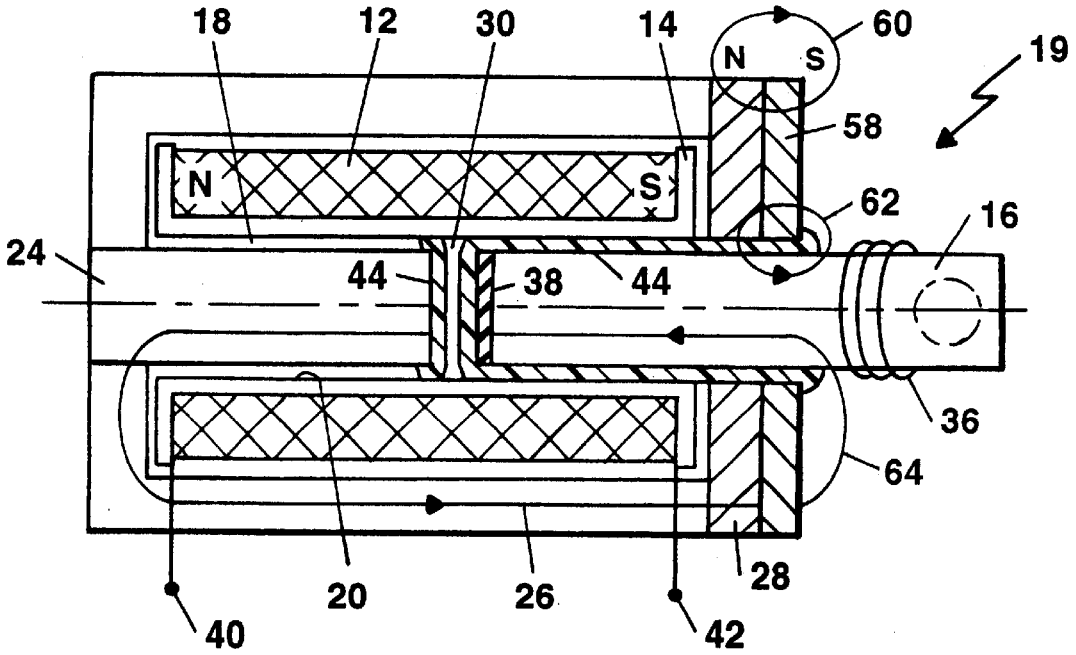
FIG. 9 is a cross sectional view of a solenoid of this invention including a permanent magnet to increase the magnetic field in the gap region.

Referring to FIG. 9 in another embodiment the solenoid 19 includes an electrically energizable coil 12, a spool 14, a moveable plunger 16, a butt 24, a casing 26, leads 40 and 42 and a pole piece 28. A primary spring 36 is mounted to movable plunger 16 in order to return plunger 16 to its original, non-energized, position. The de-energizing mechanism 38 fits in the gap between plunger 16 and butt 24 to urge plunger 16 and butt 24 apart once de-energization has occurred and the solenoid returns to a non-energized state. Ferrofluid 44 is positioned (a) within the gap 30 between the inner wall 20 of the spool 14 and the butt 24 and (b) between the inner wall 20 of spool 14 and the plunger 16. The solenoid 19 also includes a permanent magnet 58 that generates a magnetic field with the flux lines 60 and 62. The energized coil 12 provides the flux lines 64. The magnet 58 provides an increased magnetic field in the gap 30 between the plunger 16 and the butt 24 that serves to retain the ferrofluid when the solenoid is not energized. Further, the magnetic field in the gap between wall 20 and plunger 16 is increased to provide better alignment of the plunger in the gap.

Figure 10:
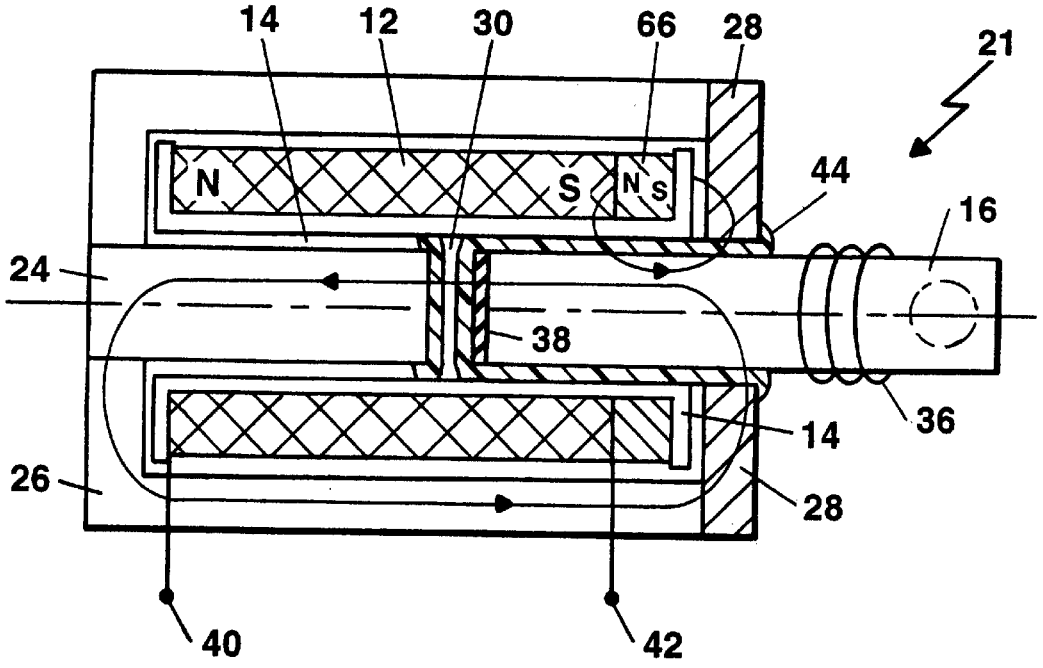
FIG. 10 is a cross sectional view of a solenoid of this invention with a permanent magnet positioned within this spool.

Referring to FIG. 10, in a further embodiment the solenoid 21 includes an electrically energizable coil 12, a spool 14, a moveable plunger 16, a butt 24, a casing 26 and a pole piece 28. A primary spring 36 is mounted to movable plunger 16 in order to return plunger 16 to its original, non-energized, position. The de-energizing mechanism 38 fits in the gap between plunger 16 and butt 24 to urge plunger 16 and butt 24 apart once de-energization has occurred and the solenoid returns to a non-energized state. The coil 12 is energized by applying a voltage between leads 40 and 42. A permanent magnet 66 is positioned within the spool 14 adjacent the coil 12. Ferrofluid 44 is positioned within gap 30 and is also positioned (a) between the spool 14 and the plunger 16 and (b) between the spool 14 and the butt 24. The magnet 66 increases the magnetic flux within the space between the plunger 16 and the spool 14 as well as in the space between plunger 16 and the pole piece 28. This, in turn, provides increased magnetic force for centering the plunger 16 and for retaining the ferrofluid 44 within the solenoid 21.

Figure 11:
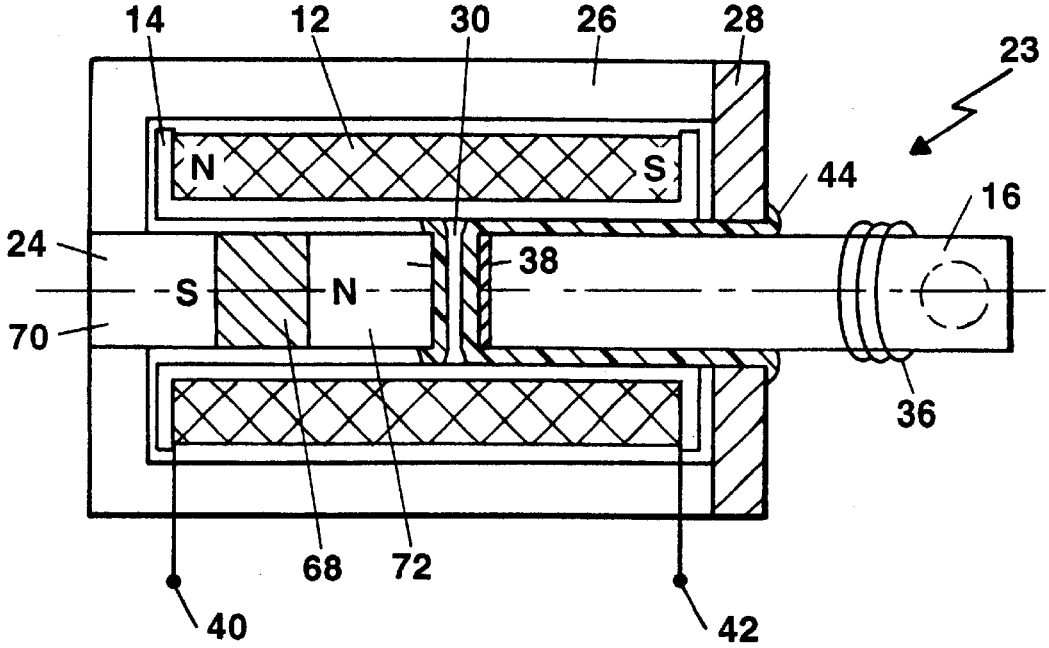
FIG. 11 is a cross sectional view of a solenoid of this invention including a permanent magnet positioned between the butt elements.

In the embodiment shown in FIG. 11 the solenoid 23 includes electrically energizable coil 12, a spool 14, a moveable plunger 16, a butt 24, a casing 26, leads 40 and 42 and a pole piece 28. A primary spring 36 is mounted to movable plunger 16 in order to return plunger 16 to its original, non-energized, position. The de-energizing mechanism 38 fits in the gap between plunger 16 and butt 24 to urge plunger 16 and butt 24 apart once de-energization has occurred and the solenoid returns to a non-energized state. A permanent magnet 68 is positioned between butt sections 70 and 72. A ferrofluid 44 is positioned within the gap 30 between plunger 16 and the pole piece 28. Ferrofluid 44 is also positioned between the butt section 72 and the spool 14. The magnet 68 increases the field between the plunger 16 and the spool 14 and between the plunger 16 and the pole piece 28, thereby providing greater retention of ferrofluid 44 within solenoid 23. In addition, the high magnetic field strength in the gap between the plunger 16 and pole piece 28 provides a higher damping effect thereby further reducing noise produced by the solenoid 23.

Figure 12:
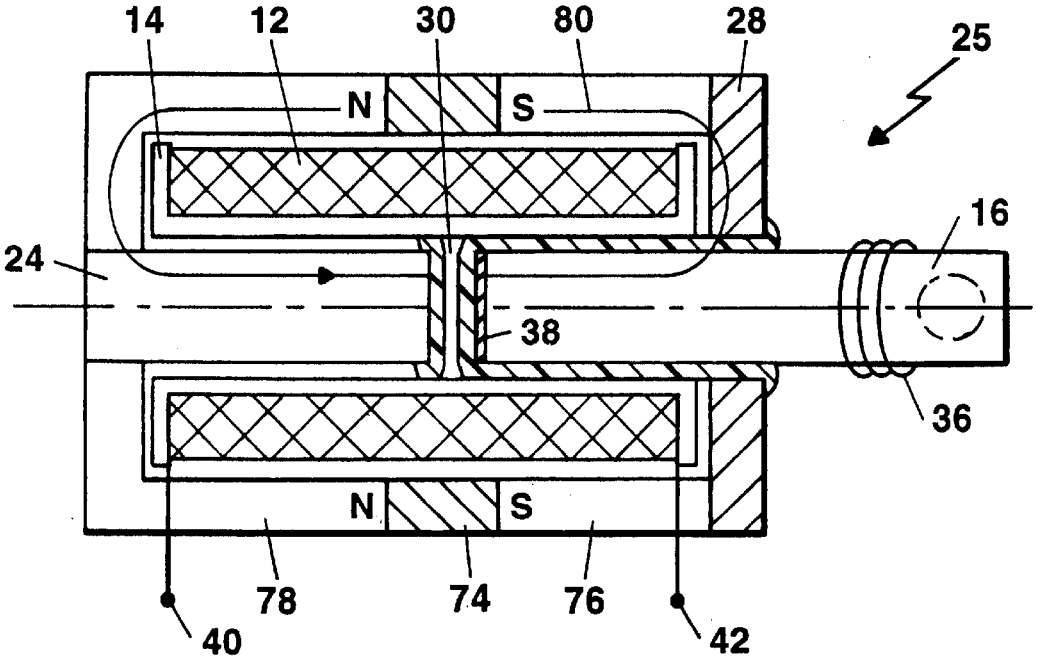
FIG. 12 is a cross sectional view of a solenoid of this invention with a permanent magnet positioned between the casing sections.

Referring to FIG. 12, the solenoid 25 includes an electrically energizable coil 12, a spool 14, a moveable plunger 16, a butt 24 and a pole piece 28. A primary spring 36 is mounted to movable plunger 16 in order to return plunger 16 to its original, non-energized, position. The de-energizing mechanism 38 fits in the gap between plunger 16 and butt 24 to urge plunger 16 and butt 24 apart once de-energization has occurred and the solenoid returns to a non-energized state. The coil 12 is provided with leads 40 and 42 to provide an electrical voltage across the coil. A permanent magnet 74 is positioned between segmented casing sections 76 and 78 which are formed from magnetic material such as steel. The magnetic flux lines of the solenoid 25 are represented by line 80. The magnet 74 has the same effect as the magnet discussed above with reference to FIG. 8.

While the solenoid described above with reference to FIGS. 7 through 12 differs in structure by the presence or absence of a permanent magnet and, when present, the location of the permanent magnet as part of the solenoid structure, the solenoid functions in essentially the same manner.

The object of the solenoid is to move the plunger 16 between a first position adjacent to or in contact with the butt 24 or to a second position wherein the plunger extends in a position more remote from the butt. Plunger movement in a first direction along an axis is effected by the generated magnetic field. When application of electrical energy ceases, the magnetic field is sufficiently reduced so that a mechanical means in the solenoid, such as the primary spring 36, effects plunger movement in a direction opposite the first direction along the axis.

The mechanism 38 is also provided to decrease de-energizing response or push-back time of the plunger 16.

What is claimed is:

1. A solenoid comprising:

a coil apparatus for generating a magnetic field along an axis;

a magnetic plunger positioned in the magnetic field and moveable from a first position to a second position along the axis in response to the coil being energized with an electrical current;

a biasing mechanism connected to the magnetic plunger and biased against the direction of travel of the magnetic plunger upon the coil being energized to urge the magnetic plunger back towards the first position;

a mechanical butt for limiting the axial movement of the plunger;

a liquid located between the plunger and the butt, wherein the liquid is a ferrofluid that comprises magnetic particles, a surfactant and a carrier liquid selected from the group consisting of a hydrocarbon, an ester, a silicone, a silahydrocarbon, a polyphenyl ether, a fluorocarbon, a chlorofluorohydrocarbon and mixtures thereof; and means for reducing a de-energizing response time between the magnetic plunger and the mechanical butt after the coil is de-energized so that the magnetic plunger returns to the first position.

2. The solenoid of claim 1, wherein the coil apparatus surrounds the plunger and the liquid is also located between the coil apparatus and the plunger.

3. The solenoid of claim 2, wherein the magnetic field has a magnetic field strength and the solenoid further comprises a magnet positioned to increase the magnetic field strength between the coil apparatus and the plunger.

4. The solenoid of claim 1, wherein the means for reducing a de-energizing response time comprises a spring having spring extensions.

5. The solenoid of claim 1, wherein the means for reducing a de-energizing response time comprises a step on either the magnetic plunger or the mechanical butt to decrease the surface area in contact with one another upon energization.

6. A solenoid comprising:

a coil apparatus for generating a magnetic field along an axis;

a magnetic plunger positioned in the magnetic field and moveable from a first position to a second position along the axis in response to the coil being energized with an electrical current;

a biasing mechanism connected to the magnetic plunger and biased against the direction of travel of the magnetic plunger upon the coil being energized to urge the magnetic plunger back towards the first position:

a mechanical butt for limiting the axial movement of the plunger;

a liquid located between the plunger and the butt; and means for reducing a de-energizing response time between the magnetic plunger and the mechanical butt after the coil is de-energized so that the magnetic plunger returns to the first position comprising a spring that is substantially spherical and positioned between the magnetic plunger and the mechanical butt.

7. A solenoid comprising:

a coil apparatus for generating a magnetic field along an axis;

a magnetic plunger positioned in the magnetic field and moveable from a first position to a second position along the axis in response to the coil being energized with an electrical current;

a biasing mechanism connected to the magnetic plunger and biased against the direction of travel of the magnetic plunger upon the coil being energized to urge the magnetic plunger back towards the first position;

a mechanical butt for limiting the axial movement of the plunger:

a liquid located between the plunger and the butt;

means for reducing a de-energizing response time between the magnetic plunger and the mechanical butt after the coil is de-energized so that the magnetic plunger returns to the first position comprising a radius of curvature on either the end of the magnetic plunger or the mechanical butt for reducing the surface area in contact between the two upon energization.

8. A solenoid comprising:

a coil apparatus for generating a magnetic field along an axis;

a magnetic plunger positioned in the magnetic field and moveable from a first position to a second position along the axis in response to the coil being energized with an electrical current;

a biasing mechanism connected to the magnetic plunger and biased against the direction of travel of the magnetic plunger upon the coil being energized to urge the magnetic plunger back towards the first position;

a mechanical butt for limiting the axial movement of the plunger:

a liquid located between the plunger and the butt;

means for reducing a de-energizing response time between the magnetic plunger and the mechanical butt after the coil is de-energized so that the magnetic plunger returns to the first position; and a pole piece having a hole therein through which the plunger passes and wherein ferrofluid is located between the pole piece and the plunger.

9. The solenoid of claim 8 wherein the means for reducing a de-energizing response time comprises a stainless steel secondary spring washer.

10. A solenoid comprising:

a coil apparatus for generating a magnetic field along an axis;

a magnetic plunger positioned in the magnetic field and moveable from a first position to a second position along the axis in response to the coil being energized with an electrical current:

a biasing mechanism connected to the magnetic plunger and biased against the direction of travel of the magnetic plunger upon the coil being energized to urge the magnetic plunger back towards the first position;

a mechanical butt for limiting the axial movement of the plunger:

a liquid located between the plunger and the butt;

means for reducing a de-energizing response time between the magnetic plunger and the mechanical butt after the coil is de-energized so that the magnetic plunger returns to the first position comprising grooves formed in either end of the magnetic plunger or the mechanical butt to reduce the surface area in contact between the plunger and the butt.

11. A solenoid comprising:

a casing formed from a magnetic material, a pole piece formed from a magnetic composition, said casing and pole piece being joined to form a housing having an internal volume, a electrically energizable coil positioned within said internal volume, means for electrically energizing said coil a support means for said coil formed from a nonmagnetic composition, said support means having a core volume, a moveable plunger positioned within said core volume and extending through said housing, a primary spring, coupled to the movable plunger, to urge the movable plunger in a direction opposite the magnetic force generated by the electrically energizable coil, a stop means positioned within said core volume for limiting axial movement of said plunger, a liquid positioned within said core volume between said stop means and said plunger and between said plunger and said support means, and, means positioned between the plunger and stop means for reducing the de-energizing response time of the plunger after the coil has been de-energized.

12. The solenoid of claim 11 further comprising a permanent magnet on or within said housing.

13. The solenoid of claim 11, the response time reducing means comprises a secondary spring positioned between the plunger and the stop means.

14. The solenoid of claim 13 wherein the secondary spring comprises a stainless steel spring washer.

15. The solenoid of claim 13 wherein the secondary spring comprises a magnetic spring washer.

16. The solenoid of claim 13 wherein the secondary spring comprises an elastic compound.

17. The solenoid of claim 13 wherein the secondary spring comprises a plurality of spring extensions along an inner circumference of the secondary spring.

18. The solenoid of claim 11, wherein said stop means has a surface adjacent said plunger and said surface has a radius of curvature.

19. The solenoid of claim 11, wherein said stop means has a non-flat surface adjacent said stop means, said surface being configured to reduce the surface tension of the liquid between said stop means and said plunger.

20. The solenoid of claim 11, wherein the liquid is a ferrofluid that comprises magnetic particles, a surfactant and a carrier liquid selected from the group consisting of a hydrocarbon, an ester, a silicone, a silahydrocarbon, a polyphenyl ether, a fluorocarbon, a chlorofluorohydrocarbon and mixtures thereof.

* * * * *